US010005279B2

(12) United States Patent
Takahashi et al.

(10) Patent No.: US 10,005,279 B2
(45) Date of Patent: Jun. 26, 2018

(54) METHOD FOR MANUFACTURING MEMS DEVICE, MEMS DEVICE, LIQUID EJECTING HEAD, AND LIQUID EJECTING APPARATUS

(71) Applicant: SEIKO EPSON CORPORATION, Tokyo (JP)

(72) Inventors: Wataru Takahashi, Chino (JP); Yasuhide Matsuo, Matsumoto (JP); Kenji Otsuka, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/299,899

(22) Filed: Oct. 21, 2016

(65) Prior Publication Data

US 2017/0113462 A1 Apr. 27, 2017

(30) Foreign Application Priority Data

Oct. 26, 2015 (JP) ..... 2015-209627

(51) Int. Cl.
*B41J 2/14* (2006.01)
*B41J 2/16* (2006.01)

(52) U.S. Cl.
CPC ..... *B41J 2/14233* (2013.01); *B41J 2/1433* (2013.01); *B41J 2/161* (2013.01); *B41J 2/162* (2013.01); *B41J 2/1607* (2013.01); *B41J 2/1623* (2013.01); *B41J 2/1628* (2013.01); *B41J 2/1629* (2013.01); *B41J 2/1646* (2013.01); *B41J 2202/11* (2013.01)

(58) Field of Classification Search
CPC ..... B41J 2/14233; B41J 2/161; B41J 2/1623; B41J 2/1629
See application file for complete search history.

(56) References Cited

U.S. PATENT DOCUMENTS 5,814,923 A * 9/1998 Shimada ..... B41J 2/161 310/311
5,896,150 A * 4/1999 Kobayashi ..... B41J 2/1612 347/54
6,475,629 B1 * 11/2002 Takeuchi ..... B32B 15/08 156/150
2008/0055362 A1 * 3/2008 Irinoda ..... B41J 2/14274 347/51
2012/0182360 A1 7/2012 Ito et al.
2014/0002550 A1 * 1/2014 Ito ..... B41J 2/055 347/70

FOREIGN PATENT DOCUMENTS

JP 11-227190 A 8/1999
JP 2012-143981 A 8/2012

* cited by examiner

*Primary Examiner* — Kristal Feggins
*Assistant Examiner* — Kendrick Liu
(74) *Attorney, Agent, or Firm* — Workman Nydegger

(57) ABSTRACT

A method for manufacturing a MEMS device in which a plurality of substrates are joined in a stacked state and one face of faces defining a space formed in one substrate of the plurality of substrates is a movable region is disclosed.

7 Claims, 8 Drawing Sheets

METHOD FOR MANUFACTURING MEMS DEVICE, MEMS DEVICE, LIQUID EJECTING HEAD, AND LIQUID EJECTING APPARATUS

BACKGROUND

1. Technical Field

The invention relates to a method for manufacturing a MEMS device for use in, for example, the ejection of a liquid from a liquid ejecting head provided in an ink jet type recording head or the like, a MEMS device, a liquid ejecting head, and a liquid ejecting apparatus. The invention particularly relates to a method for manufacturing a MEMS device formed by a plurality of substrates joined by an adhesive, a MEMS device, a liquid ejecting head, and a liquid ejecting apparatus.

2. Related Art

As micro electro mechanical systems (MEMS) devices used in liquid ejecting heads, there are devices formed by joining a plurality of substrates in a stacked state using an adhesive. Such a MEMS device is provided with a liquid flow path in communication with a nozzle, a movable region for ejecting the liquid in the liquid flow path from the nozzle by generating pressure fluctuations, and the like. For example, with the ink jet type recording head described in JP-A-11-227190, a MEMS device is described in which a substrate where a pressure chamber is formed, a vibrating plate that blocks an open face on one side of the pressure chamber, and a piezoelectric element that displaces a movable region in the vibrating plate corresponding to the pressure chamber are stacked. In this configuration, a silicon single-crystal substrate is used as the substrate forming the pressure chamber (hereinafter referred to simply as the "silicon substrate"), and the pressure chamber is formed by etching the silicon substrate. When removing a mask that is used for forming the pressure chamber by wet etching, the vibrating plate (insulating film) exposed in the pressure chamber is also exposed to the etching solution and, consequently, the vibrating plate is also etched (isotropically etched) to a point partway through the plate in the thickness direction. Moreover, when side etching (undercutting) progresses to the bottom of the wall defining the pressure chamber, an eave portion is formed in the opening edge of the vibrating plate side of the pressure chamber.

With the configuration described in JP-A-11-227190, the side etching proceeds past the opening edge of the pressure chamber and is performed on the vibrating plate and consequently, compared to a configuration in which the vibrating plate is not etched, the area of a movable region of the vibrating plate, which is displaced by the driving of the piezoelectric element, is expanded to the extent equal to the side etching. Plate thickness of the movable region is less than plate thickness in other portions of the vibrating plate. Consequently, damage such as cracks and the like readily occur in the vibrating plate due to the displacement of the movable region. Additionally, the area and the thickness of the portion that, in effect, functions as the movable region are dependent on etching accuracy and, therefore, there has been a risk of variation occurring in the vibration characteristics of the movable region (e.g. the amount of displacement and natural vibration frequency when a given external force is applied).

SUMMARY

An advantage of some aspects of the invention is that a method for manufacturing a MEMS device, a MEMS device, a liquid ejecting head, and a liquid ejecting apparatus are provided where damage such as cracks and the like in the movable region can be suppressed and vibration characteristics can be made uniform.

An aspect of the invention is a method for manufacturing a MEMS device in which a plurality of substrates are joined in a stacked state and one face of faces defining a space formed in one substrate of the plurality of substrates is a movable region, the method including: forming a mask for forming the space on a face of a side of the one substrate opposite the face of the side where the movable region is provided; forming the space in the one substrate by etching the one substrate via the mask; removing the mask using a mask removal solution and forming a recessed portion in a face of the movable region that is on a side of the space and that is exposed to the space, the recessed portion having an inner length in a direction perpendicular to a substrate stacking direction larger than an inner length of the space; forming a layer of an adhesive on the face of the side of the one substrate opposite the side of the movable region; aligning relative positions of the one substrate and another substrate; and pressing the one substrate and the other substrate with the adhesive interposed therebetween in the aligned state and introducing a portion of the adhesive that has leaked out from between the one substrate and the other substrate into the recessed portion by capillary force along a wall defining the space in the one substrate. The method further includes preliminary curing for promoting curing of the adhesive by heating being performed before the aligning.

According to this configuration, the adhesive is introduced into the recessed portion of the movable region along the wall that defines the space in the one substrate. Therefore, the periphery of the movable region is reinforced by the adhesive. As such, the occurrence of damage such as cracks and the like in the movable region due to the displacement of the movable region is suppressed. Additionally, in the preliminary curing, the viscosity of the adhesive can be adjusted as desired by adjusting the heating temperature and the like. Therefore, an amount of the adhesive introduced into the recessed portion can be controlled. As such, the area of the portion that, in effect, functions as the movable region can be brought close to a design value as intended and, as a result, the occurrence of variations in the vibration characteristics of the movable region due to the movable region expanding in the mask removal is reduced.

Additionally, the preliminary curing for promoting the curing of the adhesive by heating is performed before the aligning, and the alignment and the adhesion of the substrates are performed in a state where the viscosity of the adhesive is increased to a certain degree. Therefore, positional displacement of the substrates, prior to the adhesive between the substrates curing completely, is less likely to occur when an external force is applied, such as vibration or the like generated when transporting these substrates between the steps. As such, transportation of the substrates between steps is easier and transporting speed can be improved and, therefore, lead time can be shortened by a corresponding amount.

It is preferable that the adhesive includes an organosiloxane compound containing at least three reaction sites.

According to this configuration, the following characteristics are obtained. That is, managing the viscosity of the adhesive through heating in the preliminary curing is easy, excellent workability is ensured due to suitable fluidity and softness being exhibited at a time of application of the adhesive to the substrate, and, after curing, greater joining strength, high heat resistance, and small change in viscosity related to changes in temperature are obtained. As such, the adhesive is suitable for a configuration in which the adhesive is caused to leak out and enter the recessed portion when joining the substrates, and the movable region is reinforced by controlling the amount of the adhesive to be introduced into the recessed portion.

It is preferable that, in the preliminary curing, a viscosity of the adhesive is adjusted by controlling a heating temperature and a heating time.

According to this configuration, in the preliminary curing, the viscosity of the adhesive can be adjusted as desired using the common parameters of the heating temperature and the heating time. Therefore, the amount of the adhesive introduced into the recessed portion can be easily controlled.

It is preferable that the heating temperature is set within a range of 80° C. or higher and 100° C. or lower.

According to this configuration, due to the fact that the heating temperature is set within the range of 80° C. or higher and 100° C. or lower, the heating time for the viscosity of the adhesive to reach a viscosity as intended can be set to a practical time from the perspectives of ease, smoothness, and the like of work in the preliminary curing.

It is preferable that when the heating temperature is 80° C., the heating time is set to 5 minutes and 30 seconds or more and 18 minutes or less; when the heating temperature is 90° C., the heating time is set to 2 minutes or more and 6 minutes or less; when the heating temperature is 95° C., the heating time is set to 1 minute and 30 seconds or more and 4 minutes or less; and when the heating temperature is 100° C., the heating time is set to 1 minute or more and 2 minutes or less.

According to this configuration, due to the fact that the heating time is set in accordance with the heating temperature, the viscosity of the adhesive can be adjusted to a viscosity that is advantageous from the standpoint of controlling, for example, an amount of flow out of the adhesive.

Another aspect of the invention is a MEMS device manufactured by the method for manufacturing a MEMS device having any of the configurations described above, the device including: when viewed in a substrate stacking direction, a notch portion provided in a region where a wall defining the space in the one substrate and the recessed portion overlap, the notch portion being defined by the wall and the recessed portion. In this device, when viewed in the substrate stacking direction, a protruding length from the wall of an adhesive protruding from the notch portion into a region where the wall and the recessed portion do not overlap is within 1.5 μm.

According to this configuration, declines in the vibration characteristics of the movable region are suppressed and the occurrence of variations in the vibration characteristics is reduced.

Still another aspect of the invention is a liquid ejecting head that is an embodiment of the MEMS device described above, including: a pressure chamber as the space that is formed in the one substrate and is in communication with a nozzle that ejects a liquid; and a piezoelectric element that displaces a movable region that defines a portion of the pressure chamber.

Still another aspect of the invention is a liquid ejecting apparatus including the liquid ejecting head described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described while referencing the attached drawings. Note that the following embodiment describes various limitations as preferable specific examples of the invention but, unless explicit recitation in the following description limiting the invention is given, the scope of the invention should not be construed to be limited by these aspects. In this embodiment, the invention is described using a recording head (ink jet head) 2, which is one category of MEMS devices. In the MEMS device, for example, a driving element that receives a signal wave propagated from outside the MEMS device and drives a movable region corresponds to a piezoelectric element 18 of the recording head 2 (see FIGS. 2, 3 and other figures), and a space that allows the driving of the movable region corresponds to a pressure chamber 26 of the recording head 2 (see FIGS. 2, 3, and other figures).

Figure 1:
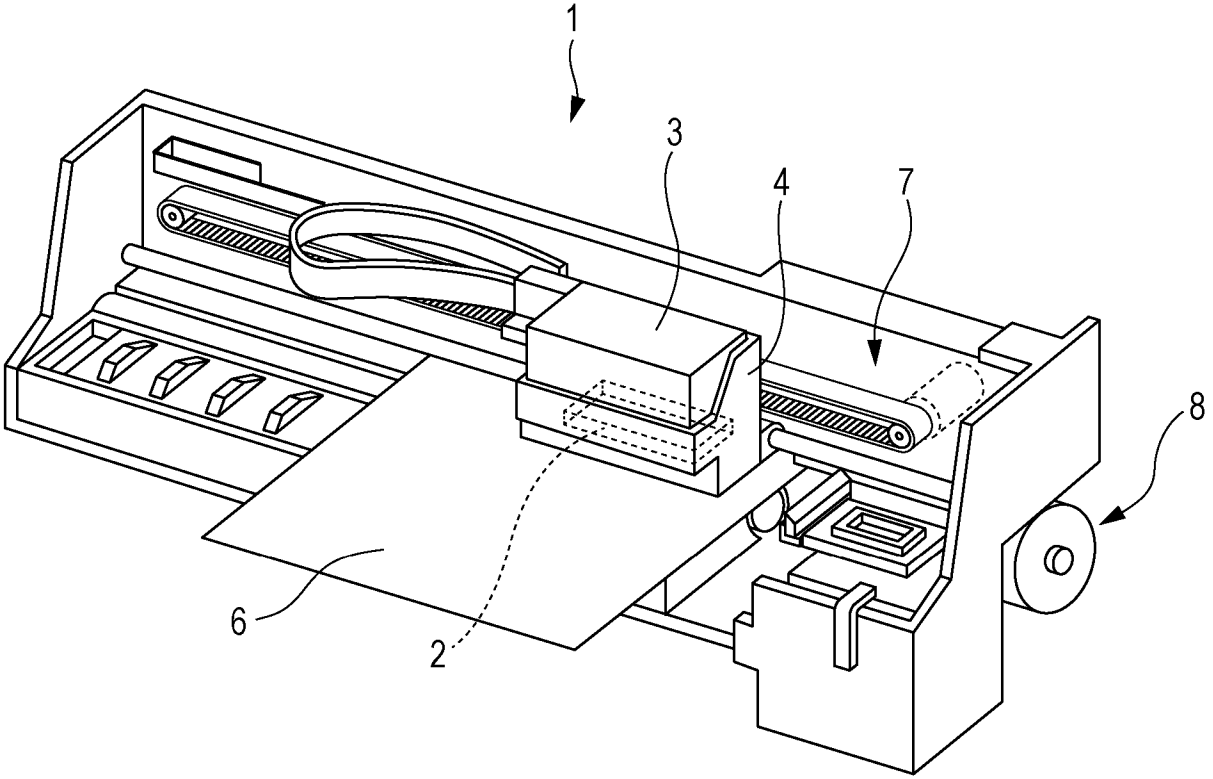
FIG. 1 is a perspective view describing an internal configuration of a printer.

FIG. 1 is a perspective view illustrating an internal configuration of a printer 1 (a type of liquid ejecting apparatus). The printer 1 includes a carriage 4 to which the recording head 2 (a type of liquid ejecting head) is attached and an ink cartridge 3 is detachably attached as a liquid supply source, a carriage moving mechanism 7 that moves the carriage 4 back and forth in a paper width direction, that is, a main scanning direction of a recording sheet 6, a paper feeding mechanism 8 that transports the recording sheet 6 in a sub scanning direction orthogonal to the main scanning direction. The carriage 4 is configured so as to be moved in the main scanning direction by the carriage moving mechanism 7. The printer 1 sequentially transports the recording sheet 6 and records text, images, and the like on the recording sheet 6 while moving the carriage 4 back and forth. Note that a configuration is possible in which the ink cartridge 3 is disposed on a main body side of the printer 1, not on the carriage 4, and the ink in the ink cartridge 3 is supplied to the recording head 2 side through an ink supply tube.

Figure 2:
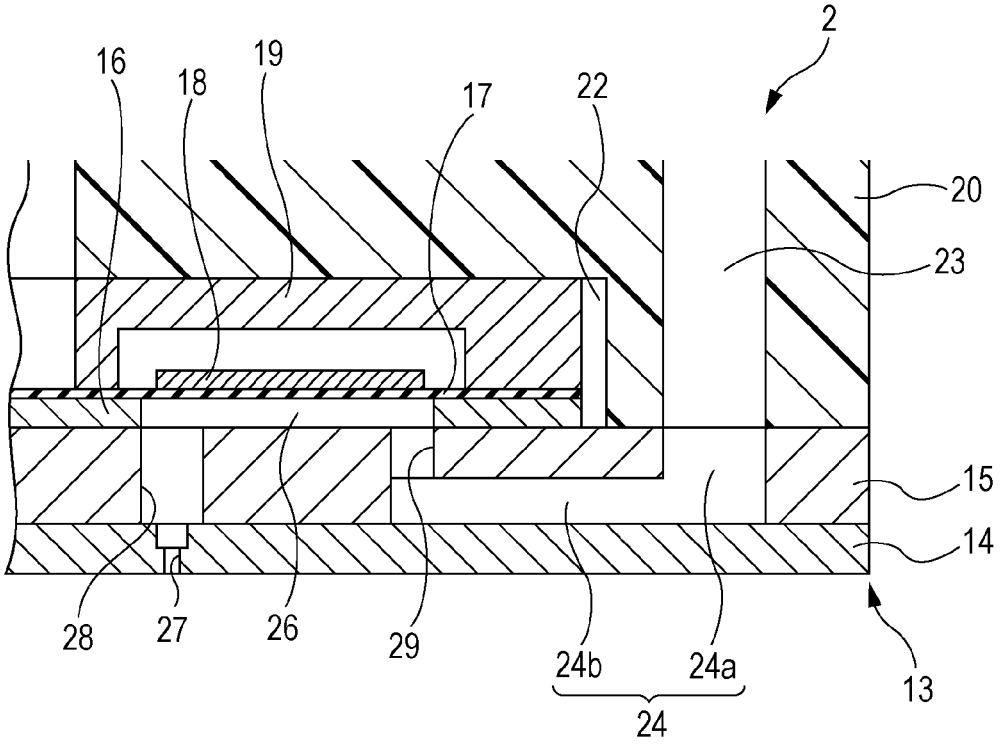
FIG. 2 is a cross-sectional view describing a configuration of a MEMS device (recording head).
Figure 3:
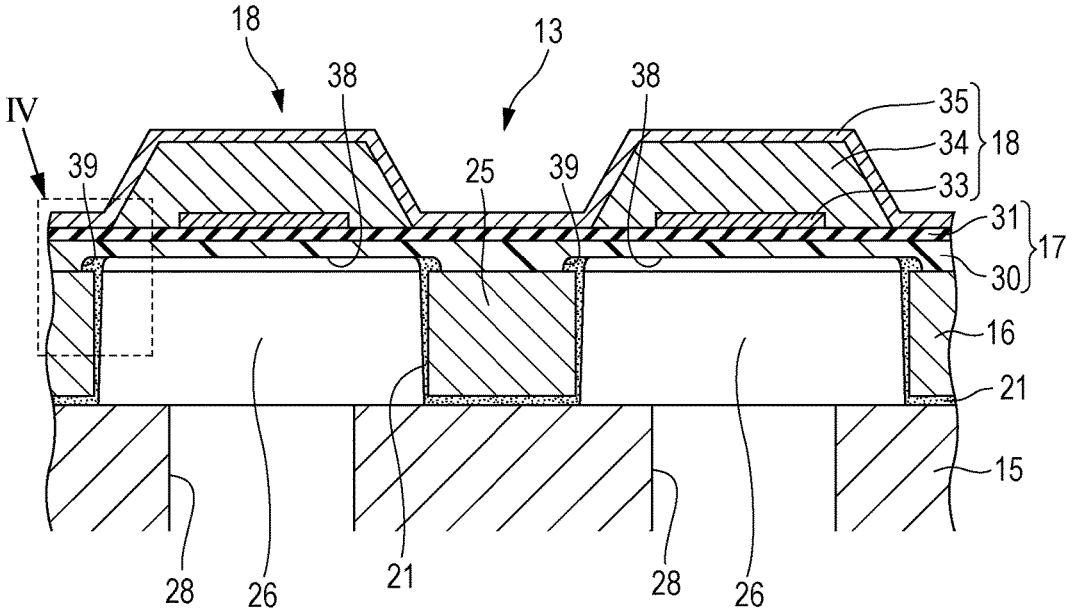
FIG. 3 is a cross-sectional view of a driving element and a space (vibration space) of the MEMS device (the recording head).
Figure 4:
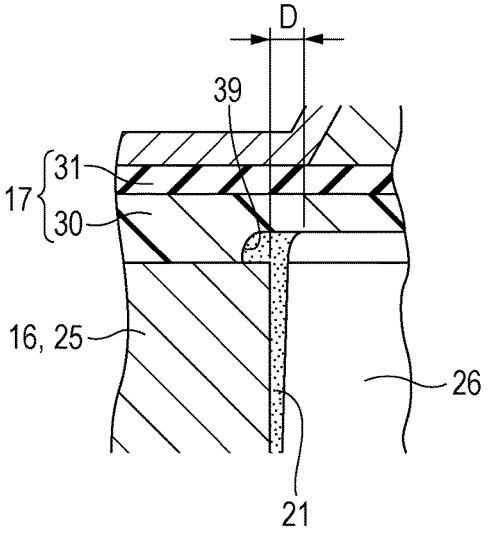
FIG. 4 is a cross-sectional view of region IV in FIG. 3 described in enlarged scale.

FIG. 2 is a cross-sectional view illustrating an internal configuration of the recording head 2. FIG. 3 is a cross-sectional view of the piezoelectric elements 18 and the pressure chambers 26 of the recording head 2 in a direction where the pressure chambers are arranged in parallel. FIG. 4 is a view of a region IV in FIG. 3 in an enlarged scale. The recording head 2 in this embodiment is formed by including a plurality of substrates, specifically by stacking, in order, a nozzle plate 14, a communication substrate 15 (corresponds to the "other substrate" in the invention), and a pressure chamber forming substrate 16 (corresponds to the "one substrate" in the invention), and joining these together using an adhesive 21 (described later). A head chip 13 is formed by stacking a vibrating plate 17 and the piezoelectric element 18 (a type of driving element) on a face of a side of the pressure chamber forming substrate 16 opposite the communication substrate 15 side. The recording head 2 is configured such that the head chip 13 is attached to a case 20 in a state where a protecting substrate 19 that protects the piezoelectric element 18 is joined to an upper face of the head chip 13.

The case 20 is a box-shaped member formed from synthetic resin and the head chip 13 is fixed to a bottom face side thereof. A housing space 22, recessed from a lower face in a rectangular manner to a point partway through the case 20 in a height direction, is formed in the lower face side of the case 20; and, when the head chip 13 is joined to the lower face, the pressure chamber forming substrate 16, the vibrating plate 17, the piezoelectric element 18, and the protecting substrate 19 in the head chip 13 are housed in the housing space 22. Additionally, an ink introduction path 23 is formed in the case 20. The ink from the ink cartridge 7 side described above is introduced into a common liquid chamber 24 through the ink introduction path 23.

The pressure chamber forming substrate 16 in this embodiment is fabricated from a silicon single-crystal substrate (hereinafter simply referred to as "silicon substrate"). A plurality of pressure chamber hollow portions, which define the pressure chambers 26 (each corresponding to the space (vibration space) of the invention) and correspond with nozzles 14 of the nozzle plate 14, are formed in the pressure chamber forming substrate 16 by anisotropic etching. The pressure chamber forming substrate 16 of this embodiment is fabricated from a silicon substrate of which upper and lower faces are (110) planes, and the pressure chamber hollow portion is a through-hole having a (111) plane as a side face (inner wall). An opening on one side (upper face side) of the pressure chamber hollow portion in the pressure chamber forming substrate 16 is sealed by the vibrating plate 17. The communication substrate 15 is joined to a side of the pressure chamber forming substrate 16 opposite the vibrating plate 17, and an opening on the other side (lower face side) of the pressure chamber hollow portion is sealed by the communication substrate 15. As a result, the pressure chamber 26 is defined and formed. Hereinafter, the term "pressure chamber 26" will include the pressure chamber hollow portion. The portion of the vibrating plate 17 sealing the upper opening of the pressure chamber 26 and defining one face of the pressure chamber 26 constitutes a movable region that is displaceable by driving of the piezoelectric element 18. Note that a configuration is possible in which the pressure chamber forming substrate 16 and the vibrating plate 17 are integrally formed. That is, the pressure chamber hollow portion may be formed by etching from the lower face side of the pressure chamber forming substrate 16 and leaving a thin portion having thin plate thickness on the upper face side; and this thin portion may be configured to function as the movable region.

The pressure chamber 26 of this embodiment is a hollow portion elongated in a direction (second direction) orthogonal to the direction (nozzle row direction, first direction) in which the nozzles 27 or the pressure chambers 26 are arranged in parallel. One end portion in a longitudinal direction of the pressure chamber 26 is in communication with the nozzle 27 via a nozzle communication opening 28 of the communication substrate 15. The other end portion in the longitudinal direction of the pressure chamber 26 is in communication with the common liquid chamber 24 via an individual communication opening 29 of the communication substrate 15. A plurality of pressure chambers 26 are formed in parallel along the nozzle row direction corresponding to nozzles 27; and the plurality of pressure chambers 26 are divided by a dividing wall 25 (corresponding to the wall defining the space in the invention (see FIG. 3)).

The communication substrate 15 is a plate member that is fabricated, similarly to the pressure chamber forming substrate 16, from a silicon substrate. A hollow portion which becomes the common liquid chamber 24 (also referred to as a reservoir or manifold) provided in common for the plurality of pressure chambers 26 in the pressure chamber forming substrate 16 is formed in the communication substrate 15 by anisotropic etching. The common liquid chamber 24 is a hollow portion elongated along the direction (nozzle row direction, first direction) in which the pressure chambers 26 are arranged in parallel. The common liquid chamber 24 in this embodiment is constituted by a first liquid chamber **24*a* that penetrates the communication substrate 15 in a plate thickness direction; and a second liquid chamber 24*b* that is formed from the lower face side of the communication substrate 15 toward the upper face side to a point partway through the plate thickness direction of the communication substrate 15 such that a thin portion is left on the upper face side. One end portion (an end portion of a side far from the nozzle 27) in the second direction of the second liquid chamber 24*b* communicates with the first liquid chamber 24*a*, and the other end portion in the same direction is formed at a position corresponding to and below the pressure chamber 26. A plurality of individual communication openings 29 that penetrate the thin portion are formed in the other end of the second liquid chambers 24*b*, that is, the end portion on the side opposite the first portion 24*a* side, along the first direction in correspondence with the pressure chambers 26 in the pressure chamber forming substrate 16. A lower end of the individual communication opening 29 communicates with the second liquid chamber 24*b* and an upper end of the individual communication opening 29 communicates with the pressure chamber 26 in the pressure chamber forming substrate 16**.

The nozzle plate 14 described above is a plate member in which a plurality of nozzles 27 are formed/opened in a row. In this embodiment, the nozzle row is formed by disposing the plurality of nozzles 27 at predetermined intervals. The nozzle plate 14 of this embodiment is fabricated from a silicon substrate. The nozzles 27, each having a cylindrical shape, is formed in the nozzle plate 14. An ink flow path is formed in the head chip 13 of this embodiment from the common liquid chamber 24 to the nozzle 27, passing through the individual communication opening 29, the pressure chamber 26, and the nozzle communication opening 28.

The vibrating plate 17 formed on the upper face of the pressure chamber forming substrate 16 is formed from, for example, an elastic film 30 made from a silicon oxide ($SiO_2$) and an insulating film 31 made from a zirconium oxide ($ZrO_2$). As illustrated in FIGS. 3 and 4, a recessed portion 38 is formed on a side of a lower face (a side of the pressure chamber 26) of the elastic film 30 of the vibrating plate 17, recessed in the lower face to a point partway through the elastic film 30 in the thickness direction thereof. The recessed portion 38 is formed in removing (described later) a masking material used when forming the pressure chamber 26 in the pressure chamber forming substrate 16. When viewed from the substrate stacking direction, an area of the recessed portion 38 is wider than an upper opening area of the pressure chamber 26. That is, an inner length L1 in a substrate face direction (direction orthogonal to the substrate stacking direction) of the recessed portion 38 is larger than an inner length L2 in the same direction of the pressure chamber 26 (see FIG. 8). Hereinafter, when viewed in the substrate stacking direction, a portion where the recessed portion 38 overlaps the dividing wall 25 (a portion defined by the recessed portion 38 and the dividing wall 25) is referred to as a notch portion 39. The notch portion 39 is formed at a portion corresponding to the periphery of the movable region. A depth of the notch portion 39 (amount of recess from the pressure chamber 26 side of the dividing wall 25) is about 0.1 to 1 μm. As illustrated in FIGS. 3 and 4, a portion of the adhesive 21 joining the pressure chamber forming substrate 16 and the communication substrate 15 has flowed along the dividing wall 25 into the notch portion 39 and cured in this state. A detailed description of this point will be given later.

Piezoelectric elements 18 are formed at positions of the vibrating plate 17 corresponding to the upper openings of the pressure chambers 26, that is, a piezoelectric element 18 is formed on each movable region. The piezoelectric element 18 of this embodiment is formed by sequentially stacking a lower electrode 33, a piezoelectric material 34, and an upper electrode 35 in order from the vibrating plate 17 side. In this embodiment, the lower electrode 33 is patterned for each of the pressure chambers 26 and functions as an individual electrode of the piezoelectric element 18. The upper electrode 35 is formed continuously along the direction (the first direction) in which the pressure chambers 26 are arranged in parallel, and functions as a common electrode of the plurality of piezoelectric elements 18. In the piezoelectric element 18, a region where the piezoelectric material 34 is sandwiched between the upper electrode 35 and the lower electrode 33 is a piezoelectric active portion that generates piezoelectric strain by applying voltage to both of the electrodes. Hereinafter, the term "piezoelectric element 18" refers to this piezoelectric active portion. The piezoelectric element 18 bends and deforms in accordance with changes in applied voltage and, as a result, the movable region of the vibrating plate 17 that defines one face of the pressure chamber 26 is displaced in a direction approaching the nozzle 27 or being distant from the nozzle 27. As a result, pressure fluctuations are generated in the ink inside the pressure chamber 26 and ink is ejected from the nozzle 27 due to the pressure fluctuations.

The nozzle plate 14, the communication substrate 15, and the pressure chamber forming substrate 16 forming the head chip 13 are joined to each other by the adhesive 21. The adhesive 21 is transferred to a joining surface of the substrates after being applied to a transfer sheet 40 (described later, see FIG. 9). The adhesive 21 preferably has strength after joining and curing, ink resistance, and also is suited to control viscosity in order to intentionally cause the adhesive 21 to leak between the pressure chamber forming substrate 16 and the communication substrate 15 so as to enter the recessed portion 38. In this embodiment, the adhesive 21 is an organosiloxane compound containing at least three reaction sites (crosslinking sites) and, more specifically is an addition-type silicone resin containing an organosiloxane compound that contains a heterocyclic compound as a basic skeleton. From the perspective of increasing adhesion to the joined object, the silicone resin preferably contains an isocyanurate compound (e.g. triallyl isocyanurate) as the heterocyclic compound and, by containing the isocyanurate compound, can be configured to have excellent compatibility with both organic components and inorganic components. Note that the adhesive 21 may contain a bifunctional organosiloxane compound in addition to the trifunctional organosiloxane compound. Examples of the heterocyclic compound include imidazole, pyrazole, pyrazine, 1,3,5-triazine, benzimidazole, benzofuran, and the like. The adhesive 21 made from such a resin composition has a main chain of chemically stable siloxsane bonds with high bonding energy to which a component containing organic groups is bonded. Therefore, suitable fluidity and softness is ensured at a time of transferring (a time of application to the substrate), and, after curing, characteristics are obtained of high heat resistance, and small change in viscosity related to changes in temperature.

By configuring the heterocyclic compound as the basic skeleton, a structure is obtained in which the silicone component is stably included, and chemical resistance (ink resistance) is increased. As a result, even when the adhesive 21 is exposed to ink in the flow path, swelling and/or deterioration of the adhesive 21 is suppressed and, therefore, initial quality at manufacture can be maintained over an extended period of time. Additionally, a three-dimensional net structure formed by three-dimensional crosslinking around the heterocyclic compound is provided and, therefore, increased strength can be obtained after the curing of the adhesive 21. Therefore, it is possible to more strongly join the structures to each other. Furthermore, various beneficial effects can be obtained such as improvements in heat resistance, improvements in crosslinking efficiency, improvements in hydrolysis resistance, and the like. Moreover, preferably, the adhesive 21 further contains an epoxy or an oxetanyl group as an organic component. As such, improvements in adhesion and crosslinkability can be obtained. The adhesive 21 contains a hydrosilane-containing component, a vinyl group-containing component, and a platinum-based catalyst in the constituent molecule; and the hydrosilane and the vinyl group are addition reacted by hydrosilylation. As a result, degassing and cure shrinkage during the process of curing by heating treatment will be less likely to occur. By utilizing the adhesive 21 described above, when applying and spreading the adhesive 21 on the transfer sheet 40, a thickness is made uniform to the extent possible, and occurrence of variations in the film thickness of the adhesive 21 can be suppressed. Additionally, adjusting the viscosity to a desired level by managing the heating temperature and the heating time in the heating treatment (the preliminary curing) is easier. As a result, the intended amount of the adhesive 21 that has leaked from between the pressure chamber forming substrate 16 and the communication substrate 15 at the time of joining the substrates to each other can be actively introduced into the recessed portion 38. This point is described below.

Figure 5:
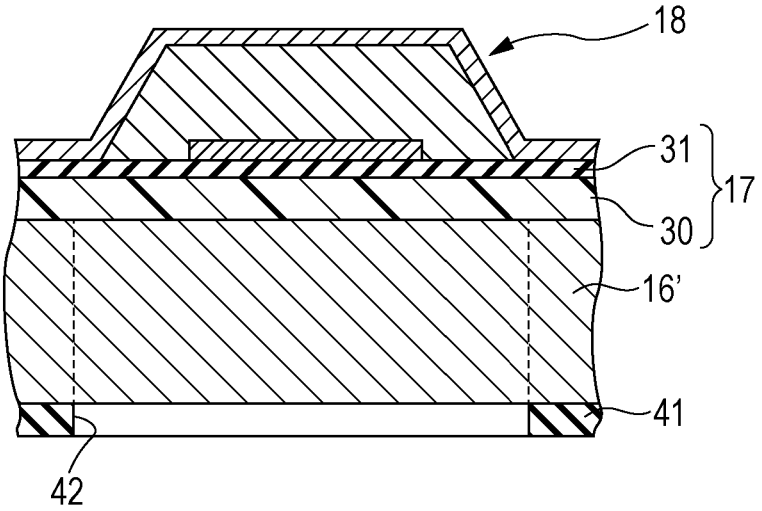
FIG. 5 is a process diagram describing a manufacturing process of the MEMS device (the recording head).
Figure 6:
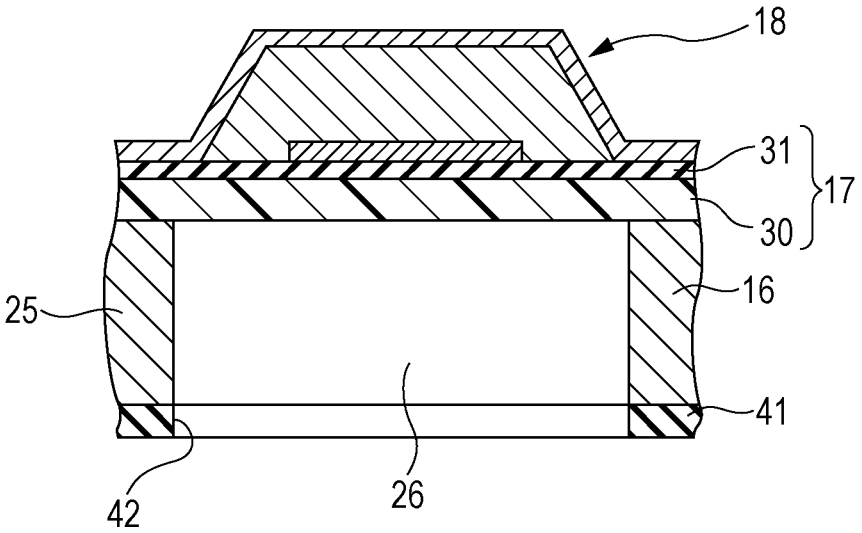
FIG. 6 is a process diagram describing the manufacturing process of the MEMS device (the recording head).

FIGS. 5 to 12 are process diagrams describing the manufacturing of the recording head 2 of this embodiment. In the drawings (with the exception of FIG. 9), a cross-section near the piezoelectric element 18 and the pressure chamber 26 in the direction in which pressure chambers are arranged in parallel is depicted. In the manufacturing process of the recording head 2 of this embodiment, first, the elastic film 30 and the insulating film 31 are sequentially formed on the silicon substrate that is the material of the pressure chamber forming substrate 16. Thus, the vibrating plate 17 is formed. Additionally, the lower electrode 33, the piezoelectric material 34, and the upper electrode 35 are sequentially deposited on the vibrating plate 17. Thus, the piezoelectric element 18 is formed. Next, after adjusting the thickness of the pressure chamber forming substrate 16, space that becomes the pressure chamber 26 is formed by subjecting the pressure chamber forming substrate 16 to anisotropic etching using an etching solution made from, for example, a potassium hydroxide solution (KOH). Specifically, as illustrated in FIG. 5, a mask 41 is formed on the lower face (i.e. the face on the side of the vibrating plate 17 opposite the face on the side where the movable region is provided) of the pressure chamber forming substrate 16 (silicon substrate 16') by a CVD or sputtering method (mask forming). In this embodiment, silicon nitride (SiN) is used as the mask 41. An opening 42 is formed in a portion of the mask 41 corresponding to the pressure chamber 26 by dry etching or the like. In this state, the pressure chamber forming substrate 16 is subjected to anisotropic etching using the etching solution described above (space forming). The etching rate for a (111) plane with KOH is much lower than the etching rate for a (110) plane and, therefore, the etching advances in the thickness direction of the pressure chamber forming substrate 16 and, as illustrated in FIG. 6, the pressure chamber 26 having (111) planes as side faces is formed.

Figure 7:
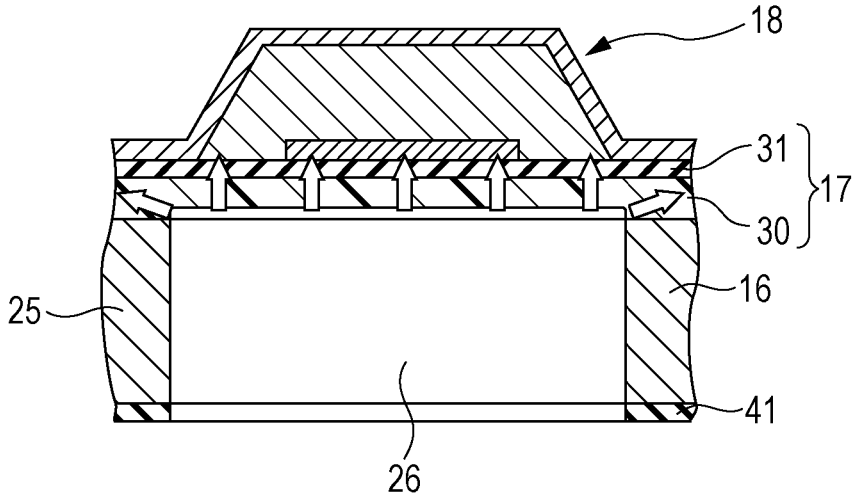
FIG. 7 is a process diagram describing the manufacturing process of the MEMS device (the recording head).
Figure 8:
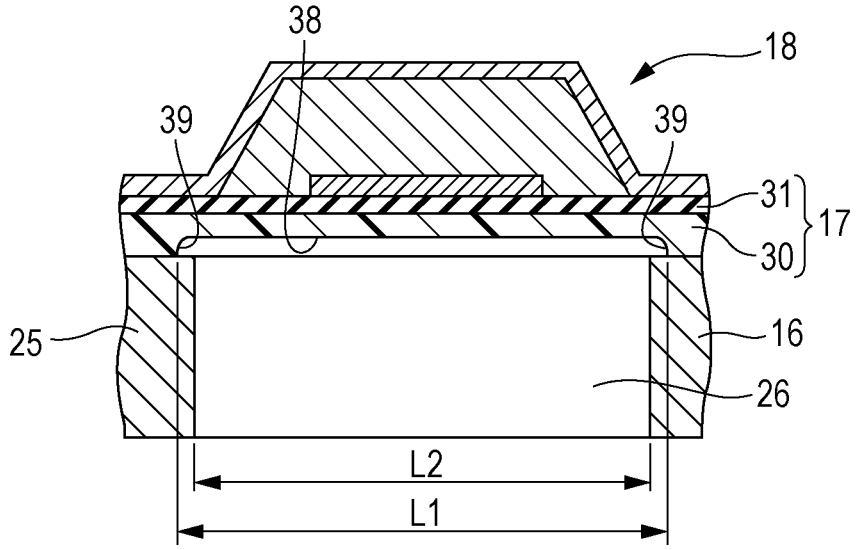
FIG. 8 is a process diagram describing the manufacturing process of the MEMS device (the recording head).

After the pressure chamber 26 has been formed, the mask 41 is removed. In this mask removal, hydrofluoric acid (HF) is used as the removing agent on the material of the mask, that is, on the silicon nitride (SiN). In the mask removal of this embodiment, the elastic film 30 made from the silicon oxide exposed in the pressure chamber 26 is exposed to an aqueous solution of hydrogen fluoride and, as illustrated in FIG. 7, is isotropically etched by the aqueous solution of hydrogen fluoride. Moreover, up to the completion of the removal of the mask 41, the elastic film 30 is side etched to a position that overlaps, in the substrate stacking direction, the dividing wall 25 that defines the pressure chamber 26 in the pressure chamber forming substrate 16. As a result, as illustrated in FIG. 8, the notch portion 39 described above is formed at the portions (the peripheral portions of the movable region) where the recessed portion 38 overlaps the dividing wall 25 in the substrate stacking direction. As described above, the recessed portion 38 is formed (recessed portion forming) via the mask forming, the space forming, and the mask removal.

Note that while detailed description is omitted, the common liquid chamber 24, the individual communication opening 29, the nozzle communication opening 28, and the like are formed in the communication substrate 15 by anisotropic etching. On the other hand, the nozzle 27 is formed in the nozzle plate 14 by dry etching. Moreover, the communication substrate 15 and the nozzle plate 14 are joined using the adhesive in a state where the nozzle 27 and the nozzle communication opening 28 have been positioned so as to be in communication. A protective film formed from a material such as, for example, a tantalum oxide ($Ta_2O_5$), a silicon oxide ($SiO_2$), or the like is formed on the inner walls of the flow path such as those of the pressure chamber 26. The protective film is lyophilic to ink.

Figure 9:
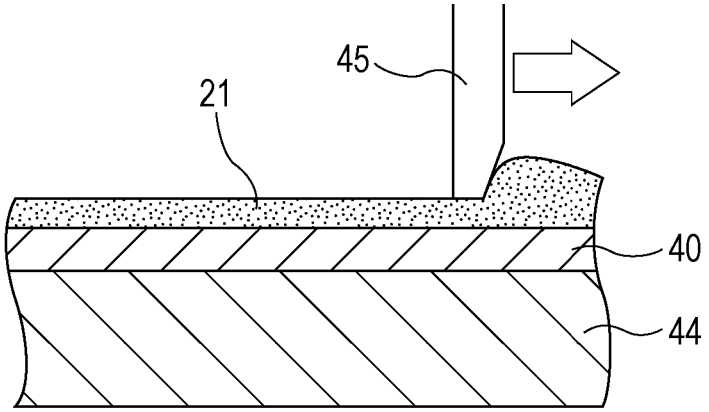
FIG. 9 is a process diagram describing the manufacturing process of the MEMS device (the recording head).
Figure 10:
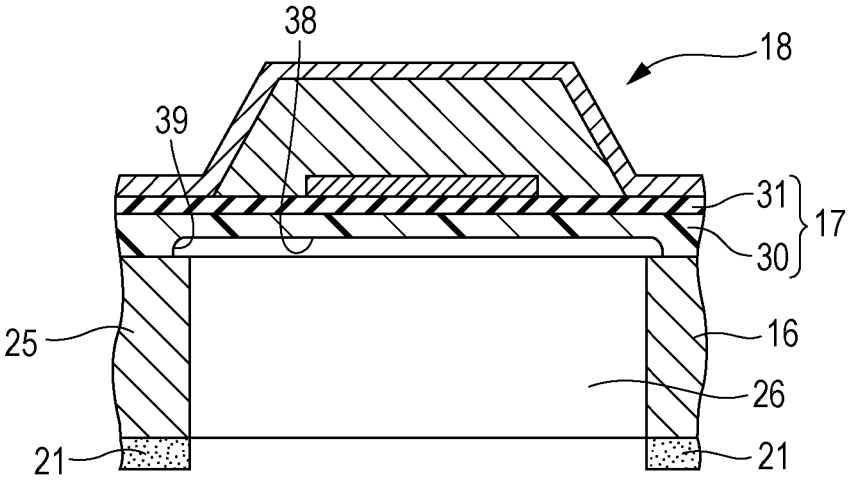
FIG. 10 is a process diagram describing the manufacturing process of the MEMS device (the recording head).
Figure 13:
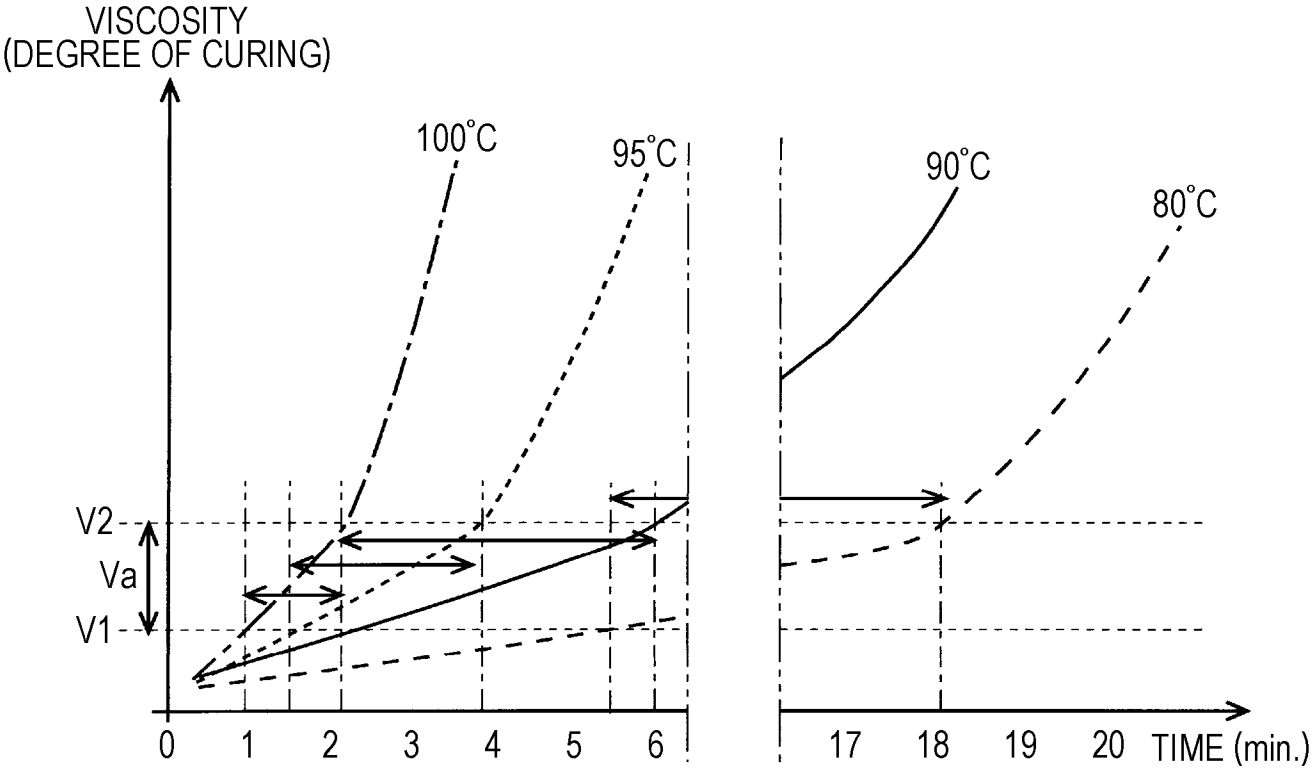
FIG. 13 is a graph describing changes in viscosity of an adhesive in preliminary curing.

Next, as illustrated in FIG. 9, on a squeegee table 44, the adhesive 21 is applied to the transfer sheet 40 that has, for example, heat resistance and flexibility, and is applied and spread to a predetermined thickness using a squeegee 45. The heating treatment is performed in this state, and curing of the adhesive 21 is promoted (preliminary curing). FIG. 13 is a graph describing changes in viscosity of the adhesive 21 in the preliminary curing. In this graph, heating time is shown on the horizontal axis and viscosity (that is, the ratio when the degree of curing is 100% when completely cured (Young's modulus)) is shown on the vertical axis. Examples of cases where the heating temperature is 80° C., 90° C., 95° C., and 100° C. are shown. In the preliminary curing, the heating temperature and the heating time are adjusted such that the viscosity of the adhesive 21 is within a target range (hereinafter, referred to as "usable region Va"). In cases where the viscosity of the adhesive 21 is lower than a lower limit value V1 of the usable range Va, that is, in cases where the viscosity is excessively low, there is a problem in that more of the adhesive 21 than is necessary will flow out from the adhesion region between the substrates when joining the substrates together. Additionally, there is a problem in that, after joining the substrates using the adhesive 21 in a state where the relative positions of the substrates are set, due to the viscosity of the adhesive 21 being low, the substrates are prone to becoming displaced when being transported to the stage of another step. On the other hand, in cases where the viscosity exceeds an upper limit value V2, that is, in cases where the viscosity is excessively high, there is a problem in that adhesive force is insufficient when joining the substrates. Additionally, in this case the adhesive 21 does not easily flow-out from the adhesion region between the substrates when joining the substrates and, as such, it is difficult to introduce the adhesive 21 into the notch portion 39. In order to prevent these problems from occurring, in the preliminary curing, the viscosity of the adhesive 21 is desired to be adjusted so as to be within the usable range Va.

In this embodiment, the addition-type silicone resin described above is used as the adhesive 21 and, as such, the viscosity thereof can be easily adjusted by controlling the heating temperature and the heating time. As a result, it is easier to ensure workability when transferring the adhesive 21 to the substrates and joining the substrates, and easier to control the flow-out of the adhesive 21 (the amount of the adhesive 21 introduced into the notch portion 39 of the recessed portion 38). Here, as illustrated in FIG. 13, settable ranges of the heating time differ depending on the heating temperature. That is, the degree of change in viscosity in accordance with the heating time increases with higher heating temperatures. In the example shown in FIG. 13, in a case where the heating temperature is 100° C., the degree of viscosity change is greatest, and the curve of the graph is steepest. In this case, the heating time is desired to be set to 1 minute or more and 2 minutes or less in order to adjust the viscosity of the adhesive 21 to be within the usable region Va and, here, the settable range of the heating time is at its narrowest. In cases where the heating temperature exceeds 100° C., the settable range of the heating time so that the viscosity of the adhesive 21 is within the usable region Va is extremely narrow and, as such, it is difficult to adjust the viscosity. Likewise, the viscosity of the adhesive 21 can be adjusted to be within the usable region Va by setting the heating time to 1 minute and 30 seconds or more and 4 minutes or less in a case where the heating temperature is 95° C., and by setting the heating time to 2 minutes or more and 6 minutes or less in a case where the heating temperature is 90° C. Moreover, the viscosity of the adhesive 21 can be adjusted to be within the usable region Va by setting the heating time to 5 minutes and 30 seconds or more and 18 minutes or less in a case where the heating temperature is 80° C. In other words, lower heating temperatures result in wider settable ranges of the heating time in which the viscosity of the adhesive 21 is within the usable region Va, and easier viscosity adjustment. However, the time spent to reach the usable region Va correspondingly increases with lower temperatures, and temperatures lower than 80° C. are impractical as the amount of time spent for the preliminary curing is excessively long. As such, with the fact that the heating temperature is set within the range of 80° C. or higher and 100° C. or lower, the heating time spent until the viscosity of the adhesive 21 is within the usable region Va can be set to a practical time from the perspectives of ease, smoothness, and the like of work in the preliminary curing. Additionally, as described above, with the fact that the heating time is set in accordance with the heating temperature, the viscosity of the adhesive can be adjusted to be within the usable region Va, which is preferable from the standpoint of controlling the amount of flow-out or the like of the adhesive. In this embodiment, the heating temperature is set to, for example, 90° C. and the heating time is set to 3 minutes.

Figure 11:
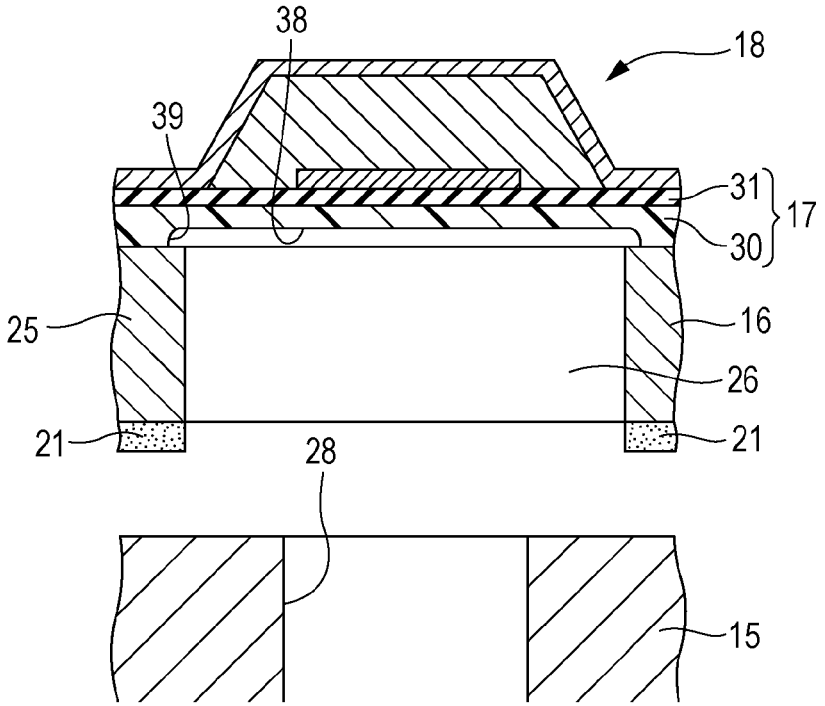
FIG. 11 is a process diagram describing the manufacturing process of the MEMS device (the recording head).

In the preliminary curing, after the viscosity of the adhesive 21 has been adjusted to be within the usable region Va, next, the adhesive 21 on the transfer sheet 40 is transferred to the joining face of the pressure chamber forming substrate 16 with the communication substrate 15. Subsequently, when the transfer sheet is peeled from the pressure chamber forming substrate 16, a layer of the adhesive 21 is formed at a uniform thickness on the joining face of the pressure chamber forming substrate 16 in regions other than the region where the opening of the pressure chamber 26 is formed (adhesive layer forming). After the adhesive 21 has been transferred to the joining face of the pressure chamber forming substrate 16, next, as illustrated in FIG. 11, the relative positions of the pressure chamber forming substrate 16 and the communication substrate 15 to be joined are adjusted (aligning). In the aligning, for example, each of the substrates is held using a jig and the substrates are moved relatively to each other and aligned (positioned) on the basis of a positioning reference such as a positioning hole or the like (not illustrated) provided in each of the substrates. Then, the pressure chamber forming substrate 16 and the communication substrate 15 are adhered to each other in the positioned state. The pressure chamber forming substrate 16 and the communication substrate 15 are pressed in a direction sandwiching the adhesive 21 in a state where the adhesive 21 is interposed between the substrates.

Figure 12:
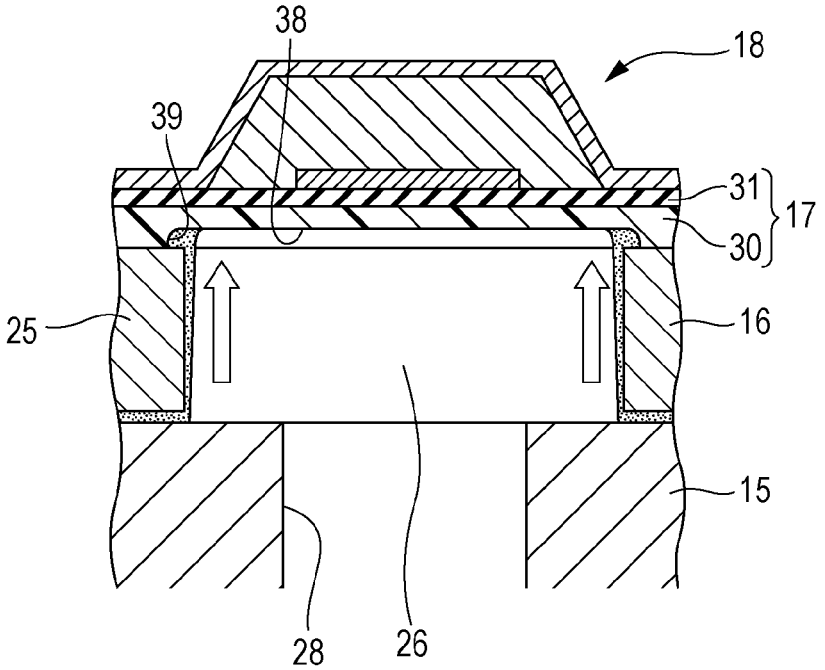
FIG. 12 is a process diagram describing the manufacturing process of the MEMS device (the recording head).

In this embodiment, the viscosity of the adhesive 21 described above is adjusted so as to be within the usable region Va. Therefore, when the adhesive 21 between the pressure chamber forming substrate 16 and the communication substrate 15 is pressed and compressed, as illustrated in FIG. 12, a portion of the adhesive 21 flows out to the pressure chamber 26 side from the adhesion region between the pressure chamber forming substrate 16 and the communication substrate 15. The adhesive 21 that has flowed out to the pressure chamber 26 side advances around the corners or the like, formed by the intersecting of the side walls defining the pressure chamber 26, toward the vibrating plate 17 side due to capillary forces (see arrows in FIG. 12) and reaches the recessed portion 38 of the vibrating plate 17. The adhesive 21 that has reached the recessed portion 38 is introduced into the notch portion 39 due to similar capillary force (adhesive introduction). That is, using the fluidity of the adhesive 21, a certain amount of the adhesive 21 is actively introduced from between the pressure chamber forming substrate 16 and the communication substrate 15 to the recessed portion 38 side along the dividing wall 25 by capillary force. As a result, at least a portion of the bottom face of the recessed portion 38 and the dividing wall 25 in the pressure chamber forming substrate 16 are adhered via the adhesive 21. Here, regarding the amount of the adhesive 21 introduced into the notch portion 39 in cases where the viscosity of the adhesive 21 is within the usable region Va, as illustrated in FIG. 4, when viewed in the substrate stacking direction, a protruding length D of the adhesive 21 from a side face (the side face on the pressure chamber 26 side) protruding from the notch region 39 into a region where the dividing wall 25 and the recessed portion 38 do not overlap is within 1.5 μm. As a result, declines in the vibration characteristics of the movable region are suppressed and the occurrence of variations in the vibration characteristics is reduced. Note that in cases where the viscosity of the adhesive 21 is within the usable region Va, the adhesive 21 is introduced at least into the notch portion 39, but there are also cases where the adhesive 21 is located more to the inner side of the notch portion 39 than the dividing wall 25 and the protruding length D is 0 μm.

After the pressure chamber forming substrate 16 and the communication substrate 15 are adhered together, curing of the adhesive 21 is promoted by another heating treatment (main curing). The Young's modulus of the adhesive 21 after the main curing is 0.01 GPa or more and 10 GPa or less. As described above, the substrates constituting the head chip 13 of the recording head 2 are joined and unitized, and an ink flow path from the common liquid chamber 24 to the nozzle 27, passing through the individual communication opening 29, the pressure chamber 26, and the nozzle communication opening 28, is formed in the head chip 13.

Here, in the head chip 13 of the recording head 2 of this embodiment, the adhesive 21 is introduced into the notch portion 39 of the recessed portion 38 and cured and, as a result, the periphery of the movable region of the vibrating plate 17 is reinforced by the adhesive 21. As such, even in cases where the movable region of the vibrating plate 17 expands in the mask removal, the occurrence of damage such as cracks and the like in the movable region (the vibrating plate 17) due to the displacement of the movable region is suppressed. Additionally, in the preliminary curing, the viscosity of the adhesive 21 can be adjusted as desired using the common parameters of the heating temperature and the heating time. Therefore, the amount of the adhesive 21 introduced into the notch portion 39 can be controlled. By controlling the amount of the adhesive 21 introduced into the notch portion 39 in this manner, the area of the portion that, in effect, functions as the movable region (the portion that actually is displaced by the driving of the piezoelectric element 18) can be brought close to a target design value and, as a result, the occurrence of variations in the vibration characteristics of the movable region for each pressure chamber and each nozzle due to the movable region expanding in the mask removal is reduced. As a result, variations in ejection characteristics (ejecting amount and ejecting speed) of the ink ejected from each of the nozzles 27 in the recording head 2 can be suppressed.

The preliminary curing for promoting the curing of the adhesive 21 is performed before the position aligning and, as such, the alignment and the adhesion of the substrates are performed in a state where the viscosity of the adhesive 21 is increased to a certain degree. Therefore, positional displacement of the substrates, prior to the adhesive 21 between the substrates being subjected to the main curing, is less likely to occur when an external force is applied, such as, for example, vibration generated when transporting these substrates between the steps. As such, transportation of the substrates between steps is easier and transporting speed can be improved and, therefore, lead time can be shortened by a corresponding amount.

Furthermore, in this embodiment, the movable region can be reinforced using the adhesive 21 which, as a result of capillary force, has followed the dividing wall 25 from between the pressure chamber forming substrate 16 and the communication substrate 15 to the recessed portion 38. Therefore, it is not necessary to provide separate materials or steps for reinforcing the movable region.

Note that in the description given above, a configuration is given by example in which a type of liquid, namely ink, is ejected from the nozzle as a result of displacement of the movable region, which defines one face of the space (pressure chamber 26) formed in the one substrate (the pressure chamber forming substrate 16). However, the invention is not limited thereto and can be applied to any MEMS device in which a plurality of substrates are joined together using an adhesive and the MEMS device includes a movable region. For example, the invention can also be applied to a sensor or the like for detecting pressure changes, vibration, displacement, or the like of a movable region. Additionally, the space for which one face is defined by the movable region is not limited to space that the liquid flows through.

In the embodiment described above, an example given in which the liquid ejecting head was described as the ink jet type recording head 2, but the invention can also be applied to other liquid ejecting heads that have a configuration in which space such as a liquid flow path or the like is defined by joining a plurality of substrates using an adhesive. For example, the invention can be applied to coloring material ejecting heads used for manufacturing color filters such as those for liquid crystal displays and the like; electrode material ejecting heads used for forming electrodes of organic electro-luminescence (EL) displays, surface-emitting displays (FED), and the like; bioorganic material ejecting heads used for manufacturing bio-chips (biochemical elements); and the like. In coloring material ejecting heads for display manufacturing devices, solutions of coloring materials of R (Red), G (Green), and B (Blue) are ejected as a type of liquid. In electrode material ejecting heads for electrode forming devices, a liquid electrode material is ejected as a type of liquid and, in bioorganic material ejecting heads for chip manufacturing devices, a solution of bioorganic material is ejected as a type of liquid.

Embodiments thus relate, to a method that includes forming a mask for forming the space on a face of a side of the one substrate opposite the face of the side where the movable region is provided; forming the space in the one substrate by etching the one substrate via the mask; removing the mask using a mask removal solution and forming a recessed portion in a face of the movable region that is on a side of the space and that is exposed to the space, the recessed portion having an inner length in a direction perpendicular to a substrate stacking direction larger than an inner length of the space; forming a layer of an adhesive on the face of the side of the one substrate opposite the side of the movable region; aligning relative positions of the one substrate and another substrate; pressing the one substrate and the other substrate with the adhesive interposed therebetween in the aligned state and introducing a portion of the adhesive that has leaked out from between the one substrate and the other substrate into the recessed portion by capillary force along a wall defining the space in the one substrate; and preliminary curing for promoting curing of the adhesive by heating being performed before the aligning.

The entire disclosure of Japanese Patent Application No.: 2015-209627, filed Oct. 26, 2015 is incorporated by reference herein.

What is claimed is:

1. A MEMS device comprising:

the MEMS device manufactured by the following method:

forming a mask for forming the space on a face of a side of the one substrate opposite the face of the side where the movable region is provided;

forming the space in the one substrate by etching the one substrate via the mask;

removing the mask using a mask removal solution and forming a recessed portion in a face of the movable region that is on a side of the space and that is exposed to the space, the recessed portion having an inner length in a direction perpendicular to a substrate stacking direction larger than an inner length of the space;

forming a layer of an adhesive on the face of the side of the one substrate opposite the side of the movable region;

aligning relative positions of the one substrate and another substrate;

pressing the one substrate and the other substrate with the adhesive interposed therebetween in the aligned state and introducing a portion of the adhesive that has leaked out from between the one substrate and the other substrate into the recessed portion by capillary force along a wall defining the space in the one substrate, the adhesive also being deposited on the wall defining the space while introducing the portion of the adhesive to the recessed portion; and preliminary curing for promoting curing of the adhesive by heating being performed before the aligning, wherein when viewed in a substrate stacking direction, a notch portion provided in a region where a wall defining the space in the one substrate and the recessed portion overlap, the notch portion being defined by the wall and the recessed portion; and wherein when viewed in the substrate stacking direction, a protruding length from the wall of an adhesive protruding from the notch portion into a region where the wall and the recessed portion do not overlap is within 1.5 μm.

2. The MEMS device according to claim 1, wherein:

the adhesive comprises an organosiloxane compound containing at least three reaction sites.

3. The MEMS device according to claim 1, wherein:

in the preliminary curing, a viscosity of the adhesive is adjusted by controlling a heating temperature and a heating time.

4. The MEMS device according to claim 3, wherein:

the heating temperature is set within a range of 80° C. or higher and 100° C. or lower.

5. The MEMS device according to claim 4, wherein:

when the heating temperature is 80° C., the heating time is set to 5 minutes and 30 seconds or more and 18 minutes or less;

when the heating temperature is 90° C., the heating time is set to 2 minutes or more and 6 minutes or less;

when the heating temperature is 95° C., the heating time is set to 1 minute and 30 seconds or more and 4 minutes or less; and when the heating temperature is 100° C., the heating time is set to 1 minute or more and 2 minutes or less.

6. A liquid ejecting head that is an embodiment of the MEMS device according to claim 1, comprising:

a pressure chamber as the space that is formed in the one substrate and is in communication with a nozzle that ejects a liquid; and a piezoelectric element that displaces a movable region that defines a portion of the pressure chamber.

7. A liquid ejecting apparatus comprising the liquid ejecting head according to claim 6.

* * * * *